United States Patent [19]

Snell et al.

[11] 4,094,781

[45] June 13, 1978

[54] SEPARATION OF SOLIDS FROM TAR SANDS EXTRACT

[75] Inventors: George J. Snell, Fords; Raymond H. Long, Morristown, both of N.J.

[73] Assignee: The Lummus Company, Bloomfield, N.J.

[21] Appl. No.: 740,616

[22] Filed: Nov. 10, 1976

[51] Int. Cl.[2] ..... C10G 1/04; B01D 21/00

[52] U.S. Cl. ..... 210/54; 208/11 LE; 208/251 R

[58] Field of Search ..... 208/11 LE, 251 R; 210/83, 54

[56] References Cited

U.S. PATENT DOCUMENTS

| | | | |
|---|---|---|---|
| 3,607,720 | 9/1971 | Paulson | 208/11 LE |
| 3,607,721 | 9/1971 | Nagy | 208/11 LE |
| 3,779,902 | 12/1973 | Mitchell et al. | 208/11 LE |
| 3,884,829 | 5/1975 | Moyer | 208/11 LE |
| 3,990,885 | 11/1976 | Baillie et al. | 208/11 LE |

OTHER PUBLICATIONS

Camp, Frederick W. The Tar Sands of Alberta Canada Cameron Engineers, Inc. 1974.

*Primary Examiner*—Delbert E. Gantz
*Assistant Examiner*—James W. Hellwege
*Attorney, Agent, or Firm*—Marn & Jangarathis

[57] ABSTRACT

Solids are separated from a tar sands extract by gravity settling or centrifugation in the presence of a liquid promoter which promotes and enhances the separation of the solid material. The liquid promoter has a characterization factor of at least 9.75, a 5 volume percent distillation temperature of at least 250° F and a 95 volume percent distillation temperature of at least 350° F and no greater than 750° F. As a result, liquid product is obtained without the necessity of preliminary coking of the entire extract.

11 Claims, 1 Drawing Figure

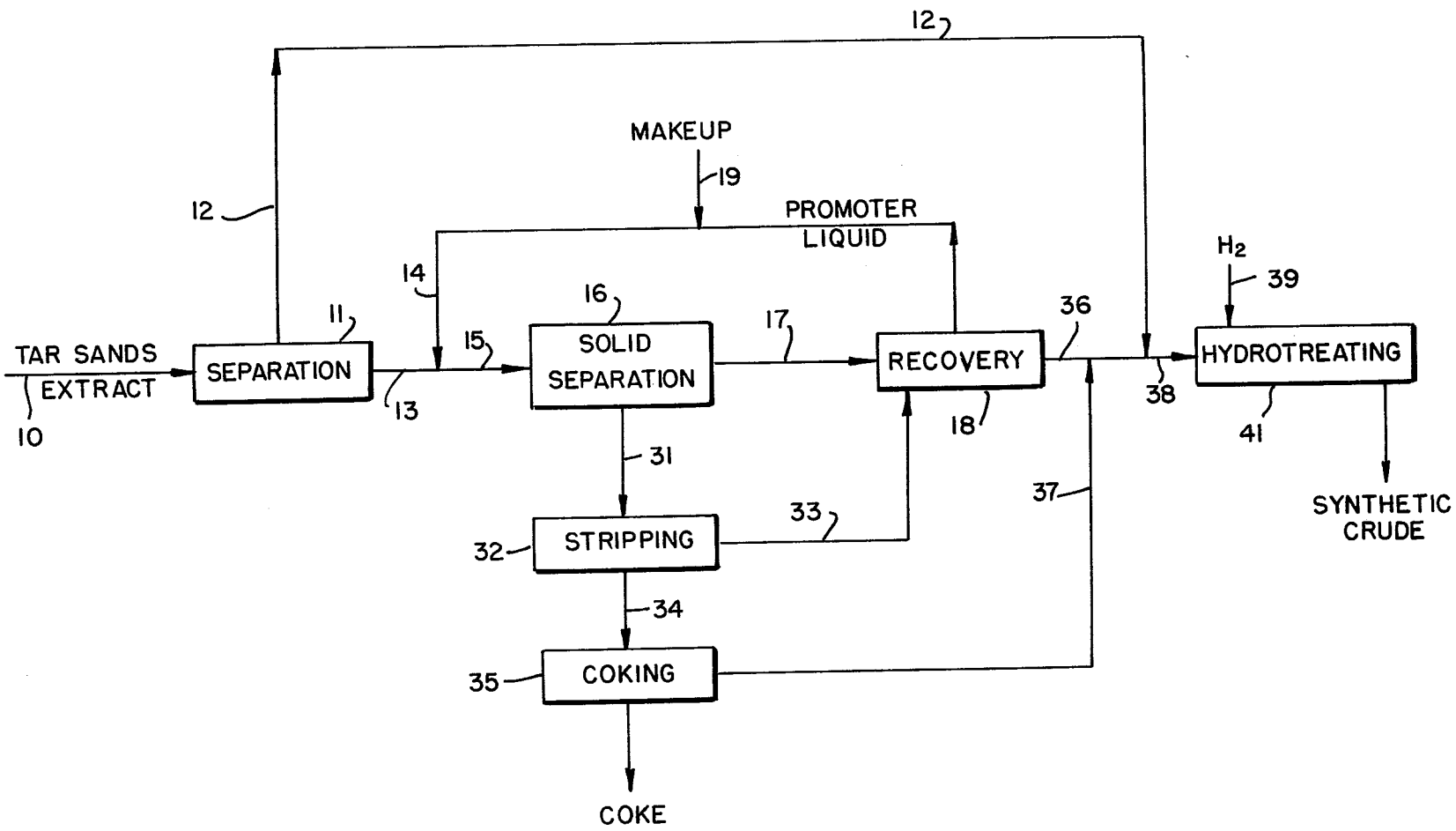
TAR SANDS EXTRACT
10
12
SEPARATION
11
13
14
15
SOLID SEPARATION
16
MAKEUP
19
PROMOTER LIQUID
17
RECOVERY
18
12
36
37
38
$H_2$
39
HYDROTREATING
41
SYNTHETIC CRUDE
31
STRIPPING
32
33
34
COKING
35
COKE

SEPARATION OF SOLIDS FROM TAR SANDS EXTRACT

This invention relates to the treatment of tar sands. More particularly, this invention relates to the separation of sand from a tar sands extract and to the upgrading of a tar sands extract to valuable liquid product.

A tar sands extract recovered from mined tar sands contains bitumen and finely divided sand. In the upgrading of such tar sands extracts, it is generally necessary to preliminarily coke the extract to permit recovery of an essentially sand free product suitable for the production of valuable liquid products, such as liquid fuels.

An object of the present invention is to provide for an improved process for upgrading tar sands extracts.

Another object of the present invention is to effect separation of sand from tar sands extracts.

A further object of the present invention is to improve liquid yields from tar sands extracts.

These and other objects of the invention should be apparent from reading the following description thereof.

In accordance with the present invention, a tar sands extract containing sand is mixed with a liquid promoter to enhance and promote the separation of sand from the tar sands extract by a gravity difference separation technique to thereby recover an essentially sand free liquid product which can be employed for the production of valuable liquid products.

The liquid which is employed to enhance and promote the separation of insoluble material is generally a hydrocarbon liquid having a characterization factor (K) of at least about 9.75 and preferably at least about 11.0 wherein:

$$K = \sqrt[3]{T_B/G}$$

wherein $T_B$ is the molal average boiling point of the liquid (°R); and $G$ is specific gravity of the liquid (60° F/60° F).

The characterization factor is an index of the aromaticity/parafinicity of hydrocarbons and petroleum fractions as disclosed by Watson and Nelson Ind. Eng. Chem. 25 880 (1933), with more parafinic materials having higher values for the characterization factor (K). The promoter liquid which is employed is one which has a characterization factor (K) in excess of 9.75.

The following Table provides representative characterization Factors (K) for various materials:

TABLE

| | |
|---|---|
| Anthracene | 8.3 |
| Naphthalene | 8.4 |
| 425–500° F Coal Tar Distillate | 8.8 |
| 550–900° F Coal Tar Distillate | 9.1 |
| 600–900° F Coal Tar Distillate | 9.0 |
| 400–450° F Coal Tar Distillate | 9.4 |
| Benzene | 9.8 |
| Tetrahydronaphthalene | 9.8 |
| o-xylene | 10.3 |
| Decahydronaphthalene | 10.6 |
| Cyclohexane | 11.0 |
| 425–500° F Boiling Range Kerosene | 11.9 |
| n-Dodecylbenzene | 12.0 |
| Propylene Oligomers (pentamer) | 12.2 |
| Cetene | 12.8 |
| Tridecane | 12.8 |
| n-Hexane | 12.9 |
| Hexadecane or cetane | 13.0 |

The liquid which is used to enhance and promote the separation of insoluble material is further characterized by a 5 volume percent distillation temperature of at least about 250° F and a 95 volume percent distillation temperature of at least about 350° F and no greater than about 750° F. The promoter liquid preferably has a 5 volume percent distillation temperature of at least about 310° F and most preferably of at least about 400° F. The 95 volume percent distillation temperature is preferably no greater than about 600° F. The most preferred promoter liquid has a 5 volume percent distillation temperature of at least about 425° F and a 95 volume percent distillation temperature of no greater than about 500° F. It is to be understood that the promoter liquid may be a hydrocarbon; e.g., tetrahydronaphthalene, in which case the 5 volume percent and 95 volume percent distillation temperatures are the same; i.e., the hydrocarbon has a single boiling point. In such a case, the boiling point of the hydrocarbon must be at least about 350° F in order to meet the requirement of a 5 volume percent distillation temperature of at least about 250° F and a 95 volume percent distillation temperature of at least about 350° F. The promoter liquid is preferably a blend or mixture of hydrocarbons in which case the 5 volume percent and 95 volume percent distillation temperatures are not the same.

The 5 volume percent and 95 volume percent distillation temperature may be conveniently determined by ASTM No. D 86-67 or No. D 1160 with the former being preferred for those liquids having a 95 volume percent distillation temperature below 600° F and the latter for those above 600° F. The methods for determining such temperatures are well known in the art and further details in this respect are not required for a full understanding of the invention. It is also to be understood that the reported temperatures are corrected to atmospheric pressure.

As representative examples of such liquids, there may be mentioned: kerosene or kerosene fraction from parafinic or mixed base crude oils; middle distillates, light gas oils and gas oil fractions from parafinic or mixed based crude oils; alkyl benzenes with side chains containing 10 or more carbon atoms; parafinic hydrocarbons containing more than 12 carbon atoms; white oils or white oil fraction derived from crude oils; alpha-olefins containing more than 12 carbon atoms; fully hydrogenated naphthalenes and substituted naphthalenes; propylene oligomers (pentamer and higher); tetrahydronaphthalene, heavy naphtha fractions, etc. The most preferred liquids are kerosene fractions; white oils; fully hydrogenated naphthalenes and substituted naphthalenes; and tetrahydronaphthalene.

The amount of liquid promoter used for enhancing and promoting the separation of sand will vary with the particular promoter liquid employed, and the tar sands extract used as a starting material. As should be apparent to those skilled in the art, the amount of liquid promoter used should be minimized in order to reduce the overall costs of the process. It has been found that by using the liquid of controlled aromaticity, in accordance with the teachings of the present invention, the desired separation of sand may be effected with modest amounts of liquid promoter. In general, the weight ratio of liquid promoter to tar sands extract may range from about 0.2:1 to about 3.0:1, preferably from about 0.3:1 to about 2.0:1 and, most preferably from about 0.3:1 to about 1.5:1. In using the preferred promoter liquid of the present invention which is a kerosene fraction having 5 percent and 95 percent volume distillation temperatures of 425° F and 500° F respectively, promoter liquid to tar sands extract weight ratios in the order of 0.4:1 to 0.8:1 have been particularly successful. It is to be understood, however, that greater amounts of liquid promoter may be employed, but the use of such greater amounts is uneconomical.

The separation of the insoluble material is effected by a technique which utilizes the difference in specific gravity between the liquid and solids; e.g., centrifugation or gravity settling.

The separation of the insoluble material is generally effected at a temperature from about 300° F to about 600° F, preferably from about 350° F to about 500° F, and a pressure from about 0 psig to about 500 psig, preferably at a pressure from about 0 psig to 300 psig. It is to be understood that higher pressures could be employed, but as should be apparent to those skilled in the art, lower pressures are preferred. The insoluble material is preferably separated by gravity settling with the essentially solid free liquid being recovered as an overflow and the insoluble material as underflow. In such gravity settling, the amount of underflow should be minimized in order to minimize the loss of heavier products in the underflow. The underflow withdrawal rate to obtain desired results is deemed to be within the scope of those skilled in the art. In general, such a rate is from about 20 to about 35 wt. % of the total feed. The residence time for such settling is generally in the order of from about 0.2 to about 6 hours, and preferably from about 0.2 to 3.0 hours.

The tar sands extract which is treated in accordance with the present invention is obtained from tar sands by any one of a wide variety of procedures. Thus, for example, tar sands is generally comprised of a dense viscous petroleum or hydrocarbon-like substance (bitumen), sand and moisture, with the tar sands, on a moisture free basis, generally being comprised of from 12–17 wt. % bitumen with the remainder being sand. The bitumen can be extracted from the mixed tar sands by hot water (150°–200° F) extraction and such extract also includes finely divided sand (generally finer than 44 micron). A major portion of the finely divided sand is separated from the extract during the extraction process by settling and centrifugation; however, the tar sands extract or bitumen resulting from the extraction process still contains significant amounts of finely divided sand, which, prior to the present invention, was difficult to separate from the extract.

The tar sands extract which is treated in accordance with the present invention generally contains from 0.5 to 5.0% of finely dispersed sand, and most generally from 1.0 to 2.0% of sand, all by weight. In addition, the extract also generally contains from about 35 to about 70%, by weight, of nondistillable liquid constituents. In addition, the extract is characterized by a specific gravity (110/60° F) in excess of 1.0, and a Conradson carbon content in excess of 18.0.

By proceeding in accordance with the present invention, there can be recovered a tar sands extract product which is essentially free of sand; i.e., the tar sands extract product contains less than 0.2%, and preferably less than 0.1% of sand, all by weight, with the sand content generally being in the order of from 0.02 to 0.08%, by weight. In addition, by proceeding in accordance with the present invention, overall essentially sand free liquid tar sands product yields are at least 65 wt.% with such essentially sand free overall liquid product yields generally being from 70 to 75%, by weight. The yield of sand free liquid product can be increased by stripping liquid from the sand containing product underflow recovered from the separation step, whereby sand free overall liquid product yields can be generally increased to the order of from 80 to 85%, by weight. A further increase in the overall sand free liquid product yields can be effected by coking the sand containing bottoms recovered from the stripping operation to produce additional liquid product and an ash containing coke, with such overall liquid yields being increased to the order of from 90 to 92%, by weight.

By proceeding in accordance with the present invention wherein an essentially sand free liquid product is recovered from the liquid extract it is possible to increase overall liquid product yields and to reduce the overall feed to the coker. Thus, in accordance with prior art procedures, the entire tar sands extract is introduced into a coker in order to produce a liquid product essentially free of sand, whereas in accordance with the present invention, only a minor portion of the tar extract (the sand containing bottoms from underflow stripping) is employed as feed to a coker for recovering liquid product.

All or a portion of the essentially sand free product recovered from the tar sands extract can be employed as feed to a hydrotreater to produce a synthetic crude. In the hydrotreating the feed is hydrogenated and/or hydrocracked to produce a synthetic crude.

In the hydrotreating, hydrogen consumption is in the order of 700 to 7000 sch/bbl of feedstock, with the specific amount of hydrogen consumption being dependent upon the desired average hydrogen/carbon atomic ratio of the synthetic crude product. Thus, for example, if a crude having an average hydrogen to carbon atomic ratio in the order of 1.8 is desired the hydrogen consumption is generally in the order of 3000 to 5000 scf/bbl. If a lower average carbon/hydrogen atomic ratio is desired, then hydrogen consumption will generally be in the order of 700 to 2100 scf/bbl. The hydrogen consumption is easily controlled by adjusting space velocity and/or temperature and the selection of optimum conditions in this respect is within the scope of those skilled in the art from the present teachings.

The hydrotreating is effected in the presence of a suitable catalyst, such as metals of sub-groups V to VIII of the Periodic Table. A preferred catalyst is one containing a metal oxide or sulfide of Group VI; e.g., molybdenum, combined with a transition group metal oxide or sulfide, such as cobalt or nickel. As representative examples, there may be mentioned: cobalt or nickel molybdate on alumina or silica-alumina, nickel tungsten sulfide on alumina or silica-alumina and the like. A dual function catalyst which exhibits good hydrogenation activity toward mono- and polycyclic aromatic compounds and also provides a cracking and/or hydrocracking function is especially preferred, particularly where lighter products are preferred. A series of hydrotreating reactions containing different catalysts can also be used. For example, a first series of reactors could contain a desulfurization/denitrification catalyst and a second series could contain a noble metal hydrogenation catalyst with an appropriate degree of hydrocracking activity. These and other operations should be apparent to those skilled in the art.

The hydrotreating is generally effected at temperatures from 500° to 900° F, preferably from 600° to 850° F operating pressures of from 500 to 5000 psig, preferably 1000 to 3000 psig; and liquid hourly space velocities from 0.5 to 4.0 hr.$^{-1}$, preferably 0.8 to 1.6 hr.$^{-1}$. It is to be understood that the above conditions are illustrative and are not intended to limit the scope of the present invention.

The synthetic crude oils produced in accordance with the present invention have a low sulfur and ash content and are charaterized by a hydrogen to carbon atomic ratio from about 1.2:1 to about 1.8:1. In addition, the synthetic crude oil produced in accordance with the invention is preferably one which is characterized by a 10 volume percent distillation temperature of at least 90° F, and a 70 volume percent distillation temperature of no greater than 900° F; however, the crude oil may or may not have a 90 volume percent distillation temperature in excess of 900° F.

The invention will be further described with respect to an embodiment thereof illustrated in the accompanying drawing wherein:

The drawing is a simplified schematic flow diagram of an embodiment of the present invention.

Referring to the drawing, a tar sands extract, containing bitumen and finely divided sand, in line 10 is introduced into a separation zone 11 to separate from the extract components boiling below the end point of the promoter liquid to be employed in the subsequent solid separation stage. As particularly described, components boiling up to about 600° F are separated in zone 11; e.g., by topping distillation and recovered through line 12.

A tar sands extract, free of components boiling up to about 600° F, withdrawn from separation zone 11 through line 13 is mixed with a promoter liquid in line 14 which is less aromatic than the extract of a type hereinabove described. In particular, the promoter is a kerosene fraction having a 5 volume percent and 95 volume percent distillation temperature within the range of from 425° to 500° F, which is derived from a naphthenic or parafinic crude oil.

The combined stream in line 15 is introduced into a solid separation zone 16 in order to recover a liquid product essentially free of sand. The solid separation zone 16 is preferably comprised of one or more gravity settlers to separate an essentially sand free liquid overflow from a sand containing liquid underflow.

The overflow essentially free of insoluble material, is withdrawn from separation zone 16 through line 17 and introduced into a recovery zone 18 for recovering promoter liquid and various fractions of the tar sands extract. The recovery zone 18 may be comprised of one or more fractionators to distill various fractions fron the product. As particularly described, the recovery zone is operated to recover a first fraction having 5 and 95 percent volume distillation temperature of from 425° to 500° F, which is to be used as the promoter liquid for enhancing and promoting separation of solid material, and a second 600° F+fraction. The promoter liquid recovered in the recovery zone is admixed with the extract in line 13 and makeup may be provided through line 19.

The underflow containing dispersed insoluble material withdrawn from separation zone 16 through line 31 is introduced into a stripping zone 32 wherein material boiling below about 800°-1000° F (at atm. pressure) is stripped therefrom and introduced into the recovery zone 18 through line 33. The stripping zone 32 is generally operated at below atmospheric pressure. The ash rich stripper bottoms in line 34 may then be optionally subjected to calcination or coking. Alternatively, part of the stripper bottoms may be used as feedstock to a partial oxidation process for producing hydrogen. As a further alternative, a portion of the stripper bottoms may be used for plant fuel. These uses and other should be apparent to those skilled in the art from the teachings herein.

In accordance with a preferred embodiment, the ash containing stripper bottoms in line 34 is coked in a coking zone 35 which can be a delayed or fluid coker, to produce an ash containing coke and further liquid product.

The sand free liquid product recovered in recovery zone 18 through line 36, as well as the tar sands extract components recovered in separation zone 11 through line 12 and the liquid coking product recovered from coking zone 35 in line 37 may be introduced through line 38, along with hydrogen gas in line 39, into a hydrotreating zone 41 to produce, as hereinabove described, a synthetic crude of low sulfur and ash content.

The present invention will be further described with respect to the following example; however, the scope of the invention is not to be limited thereby.

EXAMPLE 1

1000 gms of tar sands extract, having the inspection data compiled in Table 1, are preheated to 250° F and charged to a 2300 ml electrically heated, stainless steel shaker bomb. The said shaker bomb is outfitted with a multiplicity of valved side draw off nozzles as well as a valved bottom draw off nozzle. With shaking, the contents of the shaker bomb are quickly heated to 550° ± 10° F. Six hundred (600) gms of promoter liquid (K=11.5; 5 volume percent distillation temperature of 310° F and 95 volume percent distillation temperature of 400° F) are then quickly added via a pressurized addition bomb and the admixture is heated to 550° ± 10° F with shaking. The contents of the bomb are allowed to settle at 550° ± 10° F for 1.5 hours. An overflow product is withdrawn from a side draw off nozzle located in the lower portion of the shaker bomb and collected in a preweighed 1 gallon container, which is vented through a water cooled reflux condenser. An underflow product is now withdrawn through the bottom draw off nozzle and is collected in a 1 qt. preweighed container which also vents through an external water cooled reflux condenser. One thousand sixty (1060) gms of overflow product and 525 gms of underflow product are collected in the experiment. The sand content of the overflow product, as measured by an ASTM D482-74 ash determination, is found to be 0.03 wt.%.

A Fisher assay is run on a representative 100 gm aliquot sample of underflow prepared in accordance with the above procedure. This technique is basically a batch bench scale coking method and as such simulates in preliminary the coke yields which would be expected in commercial coking processes. The Fisher assay gas, liquid product, and char yields are 2.0 wt.%, 81.5 wt.%, and 16.5 wt.%, respectively. An overall clean oil yield of 90.3 ± 0.3 wt.% is calculated from the Fisher assay results. Clean product yield is considered to be the feedstock oil weight minus Fisher assay gas plus char yield scaled to the actual amount of overflow product, in the said calculation.

A 262.5 gm representative aliquot sample of underflow prepared above is vacuum distilled in a 500 ml round bottom distillation flask at 5 mm hg. absolute pressure. This laboratory vacuum distillation experiment was terminated when 175.0 gms of composite vacuum distillate was collected. The vacuum residue had a softening point of 332° F. An overall promoter liquid free clean liquid product of yield of 81.0 ± 0.3 wt.% is calculated for the case where underflow prepared in accordance with the subject example is vacuum stripped to a vacuum residue softening point of about 332° F. This overall clean liquid product yields corresponds to the experimental data observed in the aforementioned underflow vacuum stripping experiment.

TABLE 1

ANALYSIS OF A TYPICAL MOISTURE FREE TAR SANDS EXTRACT OR BITUMEN

| | |
|---|---|
| Specific Gravity at 110/60° F | 1.014 |
| Ash, wt. % | 1.4 |
| Conradson Carbon, wt. % | 13.6 |
| Sulfur Content, wt. % | 4.2 |
| Nitrogen Content, wt. % | 0.4 |
| Vacuum Distillation Data (ASTM) | |
| Vol % Distilled | Overhead Temp. in ° F Corr. to 760 mm Hg. Abs. Pressure |
| 0 | 450 |
| 5 | 532 |
| 10 | 598 |
| 20 | 721 |
| 30 | 820 |
| 40 | 899 |
| 50 | 990 |
| wt. % (+990° F) Residue | 56.3 wt. % |

The present invention is particularly advantageous in that liquid product suitable for upgrading to a crude oil can be recovered from a tar sands extract without the necessity of preliminarily coking the entire extract. In addition, there is obtained improved sand free liquid yields.

Numerous modifications and variations of the present invention are possible in light of the above teachings and, therefore, within the scope of the appended claims, the invention may be practiced otherwise than as particularly described.

What is claimed is:

1. A process for separating finely divided sand from a tar sands extract, comprising:

separating said finely divided sand from said tar sands extract by gravity difference separation in the presence of a promoter liquid, said promoter liquid having a characterization factor of at least 9.75, a 5 volume percent distillation temperature of at least 250° F and a 95 volume percent distillation temperature of at least 350° F and no greater than 750° F and being present in an amount sufficient to promote and enhance separation of a tar sands liquid essentially free of sand; and recovering tar sands liquid essentially free of sand.

2. The process of claim 1 wherein the promoter liquid is present in an amount to provide a promoter liquid to tar sands extract weight ratio of from 0.2:1 to 3.0:1.

3. The process of claim 2 wherein the recovered tar sands liquid contains less than 0.2%, by weight, of sand.

4. The process of claim 3 wherein the separation is effected by gravity setting with the recovered tar sands liquid being recovered as an overflow and a sand containing liquid being recovered as an underflow.

5. The process of claim 4 wherein the recovered tar sands liquid is recovered in an overall yield of at least 65 weight percent.

6. The process of claim 4 wherein the promoter liquid has a 5 volume percent distillation temperature of at least 310° F and a 95 volume percent distillation temperature of no greater than 600° F.

7. The process of claim 6 wherein the characterization factor is at least 11.0.

8. The process of claim 4 wherein the recovered sand containing liquid underflow is stripped of components boiling below about 800° to 1000° F to recover additional tar sands liquid essntially free of sand.

9. The process of claim 8 wherein the stripped underflow is coked to produce coke and further tar sands liquid essentially free of sand.

10. The process of claim 1 wherein at least a portion of the tar sands liquid essentially free of sand is hydrogenated to produce a crude oil.

11. The process of claim 10 wherein the hydrogenation is effected in the presence of a catalyst at a temperature of from 500° to 900° F and a pressure of from 500 to 5000 psig to produce a crude oil having a hydrogen to carbon atomic ratio of from 1.2:1 to 1.8:1.

* * * * *